US010161162B2

(12) United States Patent
Schaeffer et al.

(10) Patent No.: US 10,161,162 B2
(45) Date of Patent: Dec. 25, 2018

(54) ESCUTCHEON MOUNTING PLATE

(71) Applicant: Yale Security Inc., Monroe, NC (US)

(72) Inventors: Timothy Schaeffer, North Haven, CT (US); Scott Kasper, Killingworth, CT (US); Chris Hill, New Britain, CT (US); Andrew S. Geraci, Durham, CT (US)

(73) Assignee: Yale Security Inc., Monroe, NC (US)

( * ) Notice: Subject to any disclaimer, the term of this patent is extended or adjusted under 35 U.S.C. 154(b) by 0 days.

(21) Appl. No.: 15/160,587

(22) Filed: May 20, 2016

(65) Prior Publication Data

US 2016/0340930 A1 Nov. 24, 2016

Related U.S. Application Data

(60) Provisional application No. 62/164,739, filed on May 21, 2015.

(51) Int. Cl.
*E05B 9/08* (2006.01)
*E05B 15/02* (2006.01)
*E05B 3/00* (2006.01)

(52) U.S. Cl.
CPC ..... *E05B 15/02* (2013.01); *E05B 9/08* (2013.01)

(58) Field of Classification Search
CPC . E05B 15/02; E05B 9/08; E05B 15/08; E05B 15/1614; E05B 2015/0437
USPC ..... 292/336.3; 70/107–111
See application file for complete search history.

(56) References Cited

U.S. PATENT DOCUMENTS 309,205 A * 12/1884 Cowles ..... E05B 9/08 70/451
323,393 A 8/1885 Bullard
2,759,754 A * 8/1956 Kaiser ..... E05B 3/003 292/336.3
2,805,880 A 9/1957 Brozek et al.
2,810,600 A * 10/1957 Kendrick ..... E05B 15/02 292/357

(Continued)

FOREIGN PATENT DOCUMENTS

DE 9015153 U1 2/1991
DE 20014831 U1 11/2000

(Continued)

OTHER PUBLICATIONS

Yale Security Inc., International Patent Application No. PCT/US2016/033538, International Search Report and Written Opinion, dated Sep. 8, 2016.

*Primary Examiner* — Kristina R Fulton
*Assistant Examiner* — Faria F Ahmad
(74) *Attorney, Agent, or Firm* — Wolf, Greenfield & Sacks, P.C.

(57) ABSTRACT

A mount is provided for securing an escutcheon on a door. The mount comprises a plate member having a central aperture and an upper pair of elongated slots and a lower pair of elongated slots. Each of the elongated slots extends parallel to a central longitudinal axis of the plate member. A mounting stud is slidably received in at least one of the upper pair of elongated slots and the lower pair of elongated slots for positioning of the stud relative to the central aperture, wherein the studs can be located at selected distances from the central aperture for alignment with a hole through the door.

22 Claims, 20 Drawing Sheets

(56) References Cited

U.S. PATENT DOCUMENTS 3,083,563 A * 4/1963 Greenwald ..... E05B 15/1614 70/417
3,107,113 A 10/1963 Sconzo
3,389,587 A * 6/1968 Russell ..... E05B 9/08 292/337
3,910,613 A * 10/1975 Nolin ..... E05B 59/00 292/34
4,073,172 A * 2/1978 Schlage ..... E05B 17/2084 70/370
4,129,019 A * 12/1978 Urdal ..... E05B 59/00 70/107
4,156,541 A * 5/1979 Babb, Jr. ..... E05C 9/025 292/21
4,316,371 A * 2/1982 Del Nero ..... E05B 15/1614 70/417
4,333,324 A * 6/1982 Dietrich ..... E05B 55/005 292/172
4,432,576 A * 2/1984 Wartian ..... E05B 9/08 292/244
4,466,264 A * 8/1984 del Nero ..... E05B 15/1614 70/134
4,489,577 A * 12/1984 Crepinsek ..... E05B 15/02 403/348
4,530,223 A * 7/1985 Oliver ..... E05B 15/1614 70/417
4,782,677 A * 11/1988 O'Gara ..... E05B 9/08 70/417
4,809,526 A * 3/1989 Shen ..... E05B 59/00 292/21
4,813,250 A * 3/1989 Yeh ..... E05B 9/082 70/104
4,838,053 A * 6/1989 Shen ..... E05B 59/00 292/336.3
4,884,835 A 12/1989 Smallegan et al.
4,887,856 A * 12/1989 Percoco ..... E05B 9/08 292/337
4,979,767 A * 12/1990 Lin ..... E05B 59/00 292/336.3
5,161,837 A * 11/1992 O'Brien, II ..... E05B 65/1006 292/21
5,205,596 A * 4/1993 Ralph ..... E05B 3/065 292/224
5,220,816 A * 6/1993 Fish ..... E05B 9/08 70/214
5,267,461 A * 12/1993 Eizen ..... E05B 15/1614 70/417
5,372,022 A * 12/1994 Terada ..... E05B 65/523 70/71
5,400,628 A * 3/1995 Ryan ..... E05B 15/1614 70/417
5,437,484 A * 8/1995 Yamada ..... E05B 35/008 292/336.3
5,445,423 A * 8/1995 Mader ..... E05B 15/004 292/336.3
5,586,796 A * 12/1996 Fraser ..... E05B 15/0205 292/340
5,624,167 A * 4/1997 Katz ..... H01H 9/02 248/27.1
5,658,026 A * 8/1997 Nigro, Jr. ..... E05B 13/002 292/336.3
5,695,227 A * 12/1997 Smallegan ..... E05B 9/08 292/140
5,737,948 A * 4/1998 Lefkovits ..... E05B 17/142 70/164
5,762,387 A 6/1998 Edgerly et al.
5,787,741 A * 8/1998 Shen ..... E05B 15/02 292/21
5,810,402 A 9/1998 Armstrong
5,881,585 A * 3/1999 Kang ..... E05B 59/00 292/21
5,881,586 A * 3/1999 Shen ..... E05B 53/00 292/34
5,950,467 A * 9/1999 Dong ..... E05B 63/10 292/150
6,454,322 B1 * 9/2002 Su ..... E05B 59/00 292/244
6,698,260 B2 * 3/2004 Su ..... E05B 15/02 292/356
6,722,170 B2 * 4/2004 Squier ..... E05B 9/08 292/DIG. 53
6,826,937 B2 * 12/2004 Su ..... E05B 9/082 70/107
6,876,293 B2 4/2005 Frolov et al.
7,257,973 B2 * 8/2007 Romero ..... E05B 9/02 292/336.3
7,364,212 B1 * 4/2008 Fan ..... E05B 1/003 292/33
7,380,847 B2 * 6/2008 Rodriguez ..... E05B 63/0043 292/1
7,588,272 B2 * 9/2009 Gephart ..... E05B 3/00 292/336.3
D618,082 S * 6/2010 Lambrou ..... D8/343
7,926,315 B2 * 4/2011 Poletti ..... E05B 59/00 292/336.3
7,984,631 B2 7/2011 Case et al.
8,161,780 B1 * 4/2012 Huml ..... E05B 15/02 292/142
8,424,928 B2 * 4/2013 Lin ..... E05B 3/00 292/336.3
9,341,000 B2 * 5/2016 Van Parys ..... E05B 65/1086
2003/0056557 A1 * 3/2003 Squier ..... E05B 9/08 70/278.1
2003/0192355 A1 * 10/2003 Char ..... E05B 9/084 70/107
2004/0205936 A1 * 10/2004 Denys ..... E05B 15/02 16/412
2006/0038419 A1 * 2/2006 Lee ..... E05B 15/02 292/357
2006/0138788 A1 6/2006 Winardi et al.
2006/0152020 A1 * 7/2006 Gephart ..... E05B 3/00 292/336.3
2006/0226948 A1 * 10/2006 Wright ..... E05B 47/0673 340/5.25
2008/0116699 A1 5/2008 Karcher et al.
2008/0217930 A1 * 9/2008 Bennett ..... E05B 85/045 292/253
2008/0302149 A1 12/2008 Case et al.
2009/0031769 A1 * 2/2009 Dolev ..... E05B 9/084 70/367
2011/0248518 A1 * 10/2011 Tien ..... E05B 13/005 292/336.3

FOREIGN PATENT DOCUMENTS

DE 10260413 A1 7/2004
GB 2460222 A 11/2009
WO 2010001170 A2 1/2010
WO 2011079972 A1 7/2011

* cited by examiner

ESCUTCHEON MOUNTING PLATE

CROSS-REFERENCES

This application is related to U.S. provisional application No. 62/164,739, filed May 21, 2015, entitled "ESCUTCHEON MOUNTING PLATE", naming Timothy Schaeffer, Scott Kasper, Chris Hill and Andrew S. Geraci as the inventors. The contents of the provisional application are incorporated herein by reference in their entirety, and the benefit of the filing date of the provisional application is hereby claimed for all purposes that are legally served by such claim for the benefit of the filing date.

BACKGROUND

Door hardware is described and, more particularly, a mounting plate for an escutcheon, wherein the mounting plate can be used as a universal mount for securing the escutcheon to different types and models of door hardware.

Escutcheons and associated door hardware are available for installation on either newly manufactured doors or on currently installed doors which require retrofit. Escutcheons are a single piece that is substantially planar, or escutcheons may be configured in a non-planar shape that extends outwardly from the door surface. Escutcheons are attached vertically on a major surface of a door around a latch or lock operator as an attractive trim piece. Escutcheons protect and decorate the area around the latch and lock operator.

Escutcheons are normally fixed through the door to door hardware on the opposite side of the door. During installation, a mounting plate for the escutcheon is initially secured in position by fasteners extending through holes drilled through the door. At least some of the fasteners extend through the mounting plate on the one side of the door and engage in internally threaded bosses cast into the door hardware on the other side of the door.

Other than an opening for a latch operator, there is no recognized standard for the spacing of holes drilled through a door to accept fasteners for mounting an escutcheon. Moreover, the location and size of mounting holes is different for various types of door locks made by different manufacturers. For example, escutcheon mounting plates for mortise locks are different from escutcheon mounting plates for tubular handlesets due to different door preparation required for mortise and tubular lock assemblies.

Because the spacing and size of mounting openings for an escutcheon mounting plate must be matched to the location and size of various mounting patterns, manufacturers are required to make a different escutcheon mounting plate for each lock type. This limits the functional adaptability of escutcheons and requires multiple mounting plates for escutcheons to be inventoried. Alternatively, customized hole patterns may be drilled through the mounting plate to accommodate the door lock mounting holes, but this is often time consuming and difficult, and sometimes may require filling of the existing holes.

For the foregoing reasons, there is a need for a universal mounting plate for an escutcheon for use with a range of locks and handlesets on the market. The universal mounting plate should be compatible with both tubular and mortise locks, as well as exit devices. Ideally, the mounting plate will have openings for fasteners which enable the position of the fasteners to be adjusted relative to existing mounting holes, wherein the adjustability of the fasteners facilitates installation. Accordingly, the new mounting plate will be configured to accommodate different fastener patterns and fittings of the associated escutcheon to door hardware using existing fixing holes formed through the door.

SUMMARY

A mount is provided for securing an escutcheon on a major side surface of a door having opposite major side surfaces and a plurality of holes therethrough for passing a latch spindle and fasteners. The mount comprises an elongated planar plate member adapted to be secured to the major side surface of the door, the plate member having an upper end and a lower end and a central longitudinal axis extending between the upper end and the lower end. The plate member has a central aperture symmetrically disposed on the central longitudinal axis and an upper pair of elongated slots mirror symmetrically arranged with respect to the central longitudinal axis adjacent the upper end of the plate member and a lower pair of elongated slots mirror symmetrically arranged with respect to the central longitudinal axis adjacent the lower end of the plate member. Each of the elongated slots extends parallel to and equidistant from the central longitudinal axis. A mounting stud is slidably received in at least one of the upper pair of elongated slots and the lower pair of elongated slots for positioning of the stud relative to the central aperture, wherein the studs can be located at selected distances from the central aperture for alignment with a hole through the door.

A door assembly is also provided and comprises a door having opposite major side surfaces and a plurality of holes therethrough for passing a latch spindle and fasteners. A mount for securing an escutcheon on one of the major side surfaces of the door comprises an elongated planar plate member configured to be secured to the major side surface of the door, the plate member having an upper end and a lower end and a central longitudinal axis extending between the upper end and the lower end. The plate member has a central aperture symmetrically disposed on the central longitudinal axis and an upper pair of elongated slots mirror symmetrically arranged with respect to the central longitudinal axis adjacent the upper end of the plate member and a lower pair of elongated slots mirror symmetrically arranged with respect to the central longitudinal axis adjacent the lower end of the plate member. Each of the elongated slots extends parallel to and equidistant from the central longitudinal axis. A mounting stud is slidably received in at least one of the upper pair of elongated slots and the lower pair of elongated slots for positioning of the stud relative to the central aperture. The studs can be located at selected distances from the central aperture for alignment with a hole through the door when the door aperture is aligned with the central aperture of the plate member.

BRIEF DESCRIPTION OF THE DRAWINGS

For a more complete understanding of the escutcheon mounting plate, reference should now be had to the embodiments shown in the accompanying drawings and described below. In the drawings.

DESCRIPTION

Certain terminology is used herein for convenience only and is not to be taken as a limitation on the invention. For example, words such as "upper," "lower," "left," "right," "horizontal," "vertical," "upward," and "downward" merely describe the configuration shown in the FIGs. Indeed, the components may be oriented in any direction and the terminology, therefore, should be understood as encompassing such variations unless specified otherwise.

Figure 1:
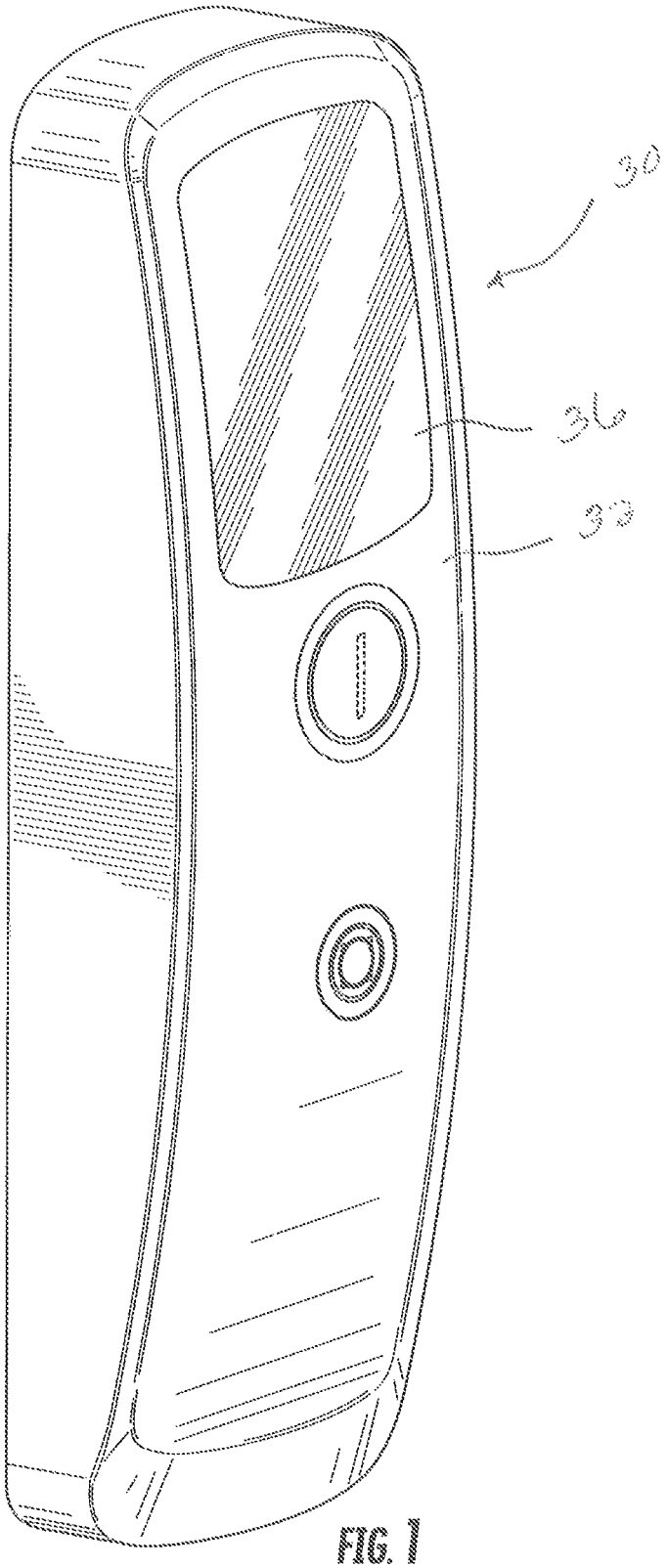
FIG. 1 is a front perspective view of an exemplary embodiment of an escutcheon including a keypad for use with a mounting plate.
Figure 2:
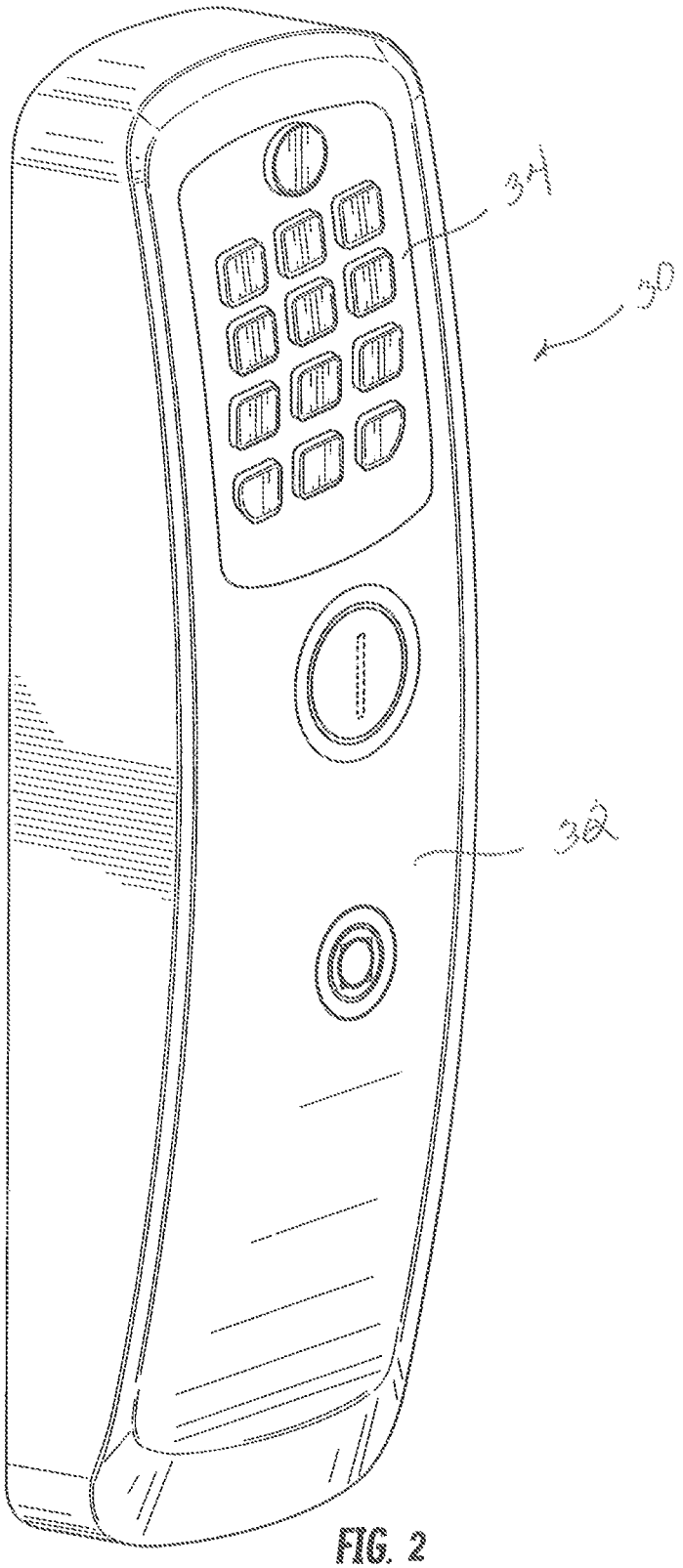
FIG. 2 is a front perspective view of an exemplary embodiment of an escutcheon including a display screen for use with a mounting plate.

Referring now to the drawings, wherein like reference numerals designate corresponding or similar elements throughout the several views, two embodiments of an escutcheon for use with a mounting plate as described herein are shown in FIGS. 1 and 2 and generally designated at 30. In one embodiment, the escutcheon 30 comprises a cover 32 including a display screen 36 for displaying information (FIG. 1). In the second embodiment, the escutcheon 30 comprises a cover 32 including a keypad 34 for entering, for example, a security code (FIG. 2). The escutcheons shown in FIGS. 1 and 2 are shown and described in U.S. patent application Ser. Nos. 29/532,585 and 29/532,588, the contents of which are hereby incorporated by reference. It is understood, however, that the mounting plate described herein may be used with any conventional escutcheon.

Figure 3:
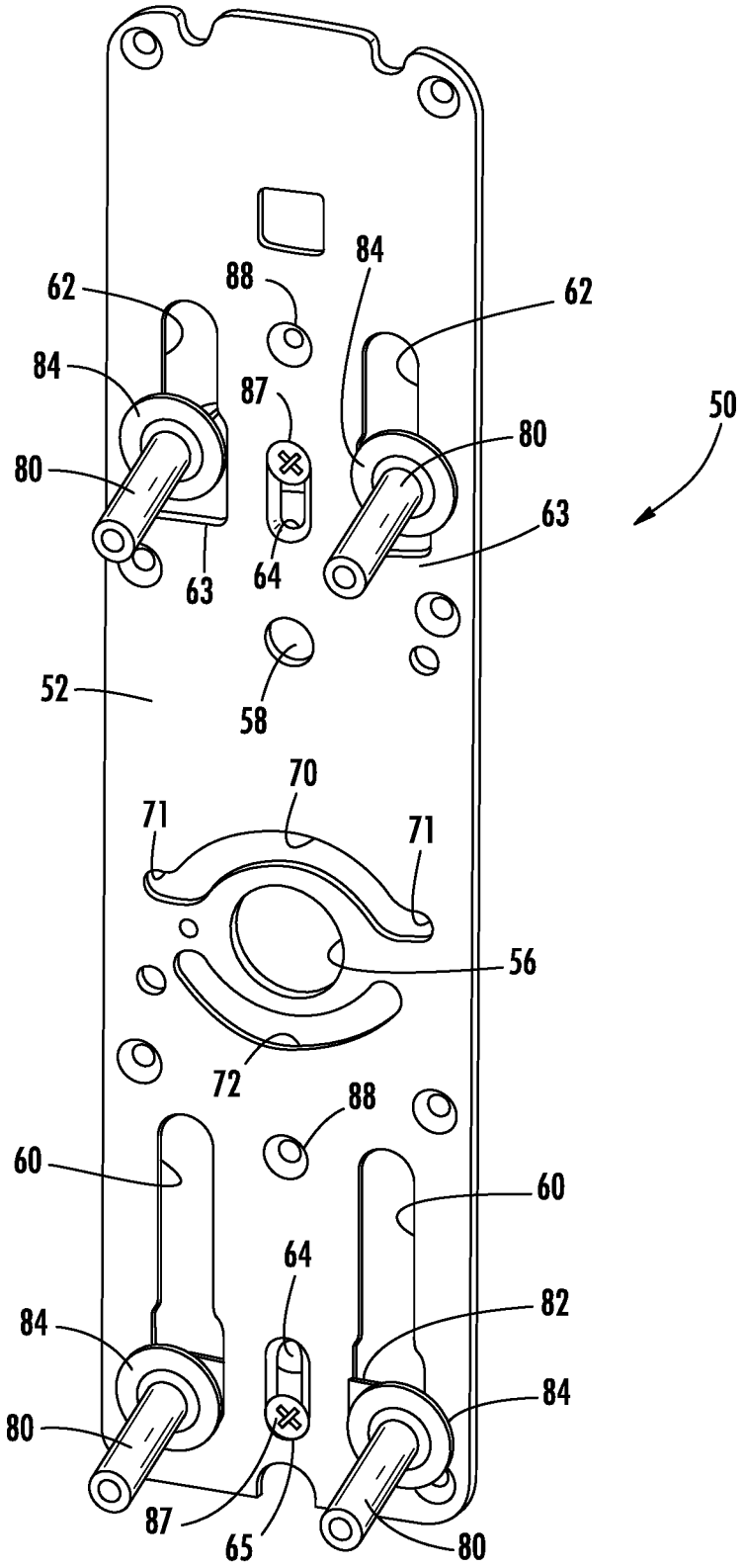
FIG. 3 is an inner perspective view of an embodiment of a mounting plate for use in securing an escutcheon to one side of a door and to a pushbar exit device on another side of the door.
Figure 4:
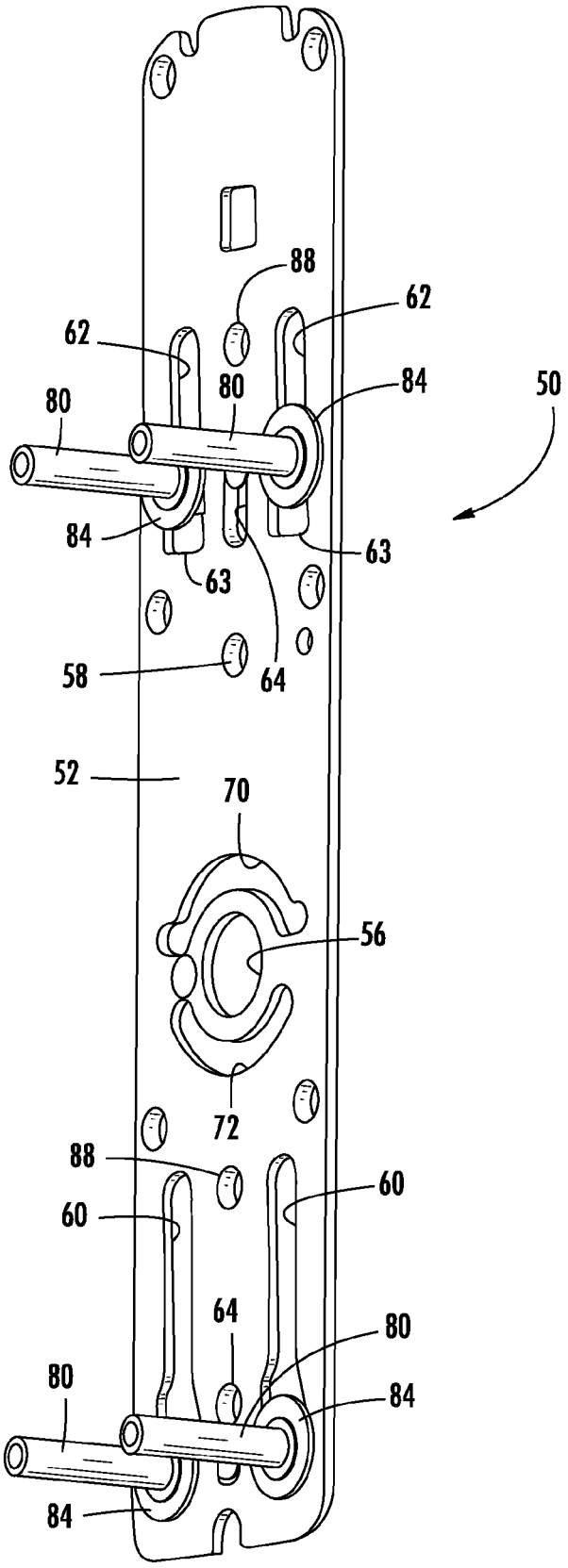
FIG. 4 is an inner side perspective view of the mounting plate as shown in FIG. 3.

Each embodiment of the escutcheon 30 is secured by a universal mounting plate as shown in FIG. 3 and generally designated at 50. The mounting plate 50 is configured to be positioned against a door surface on one side of the door 31. The mounting plate 50 has a plurality of holes therethrough for passing, for example, fasteners, a spindle for a latch operator and an actuator for a cylinder lock. One or more corresponding openings are provided in or through the door such that the mounting plate 50 is secured to the one surface of the door and to underlying door hardware and lock components on the opposite surface of the door. The remaining elements of the escutcheon 30, including the cover 32 and the key pad 34 or display screen 36, a latch operator 38, and a cylinder lock 40 are mounted directly or indirectly to the mounting plate 50. The latch operator 38 is operatively coupled to a latch or lock mechanism (not shown) mounted within an edge of the door and arranged to be actuated via the latch operator 38.

Figure 7:
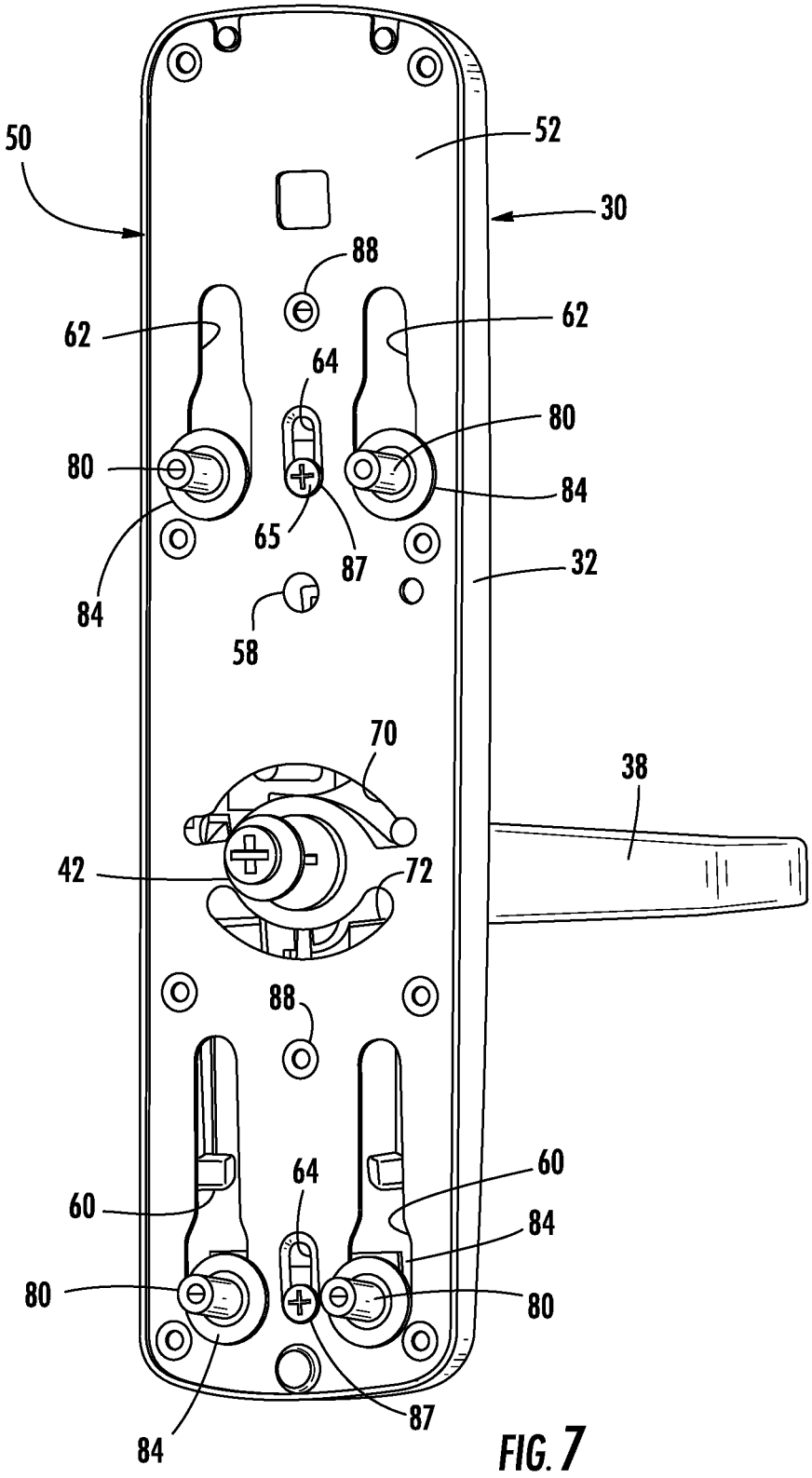
FIG. 7 is an inner perspective view of the mounting plate as shown in FIG. 1 including an escutcheon.
Figure 8:
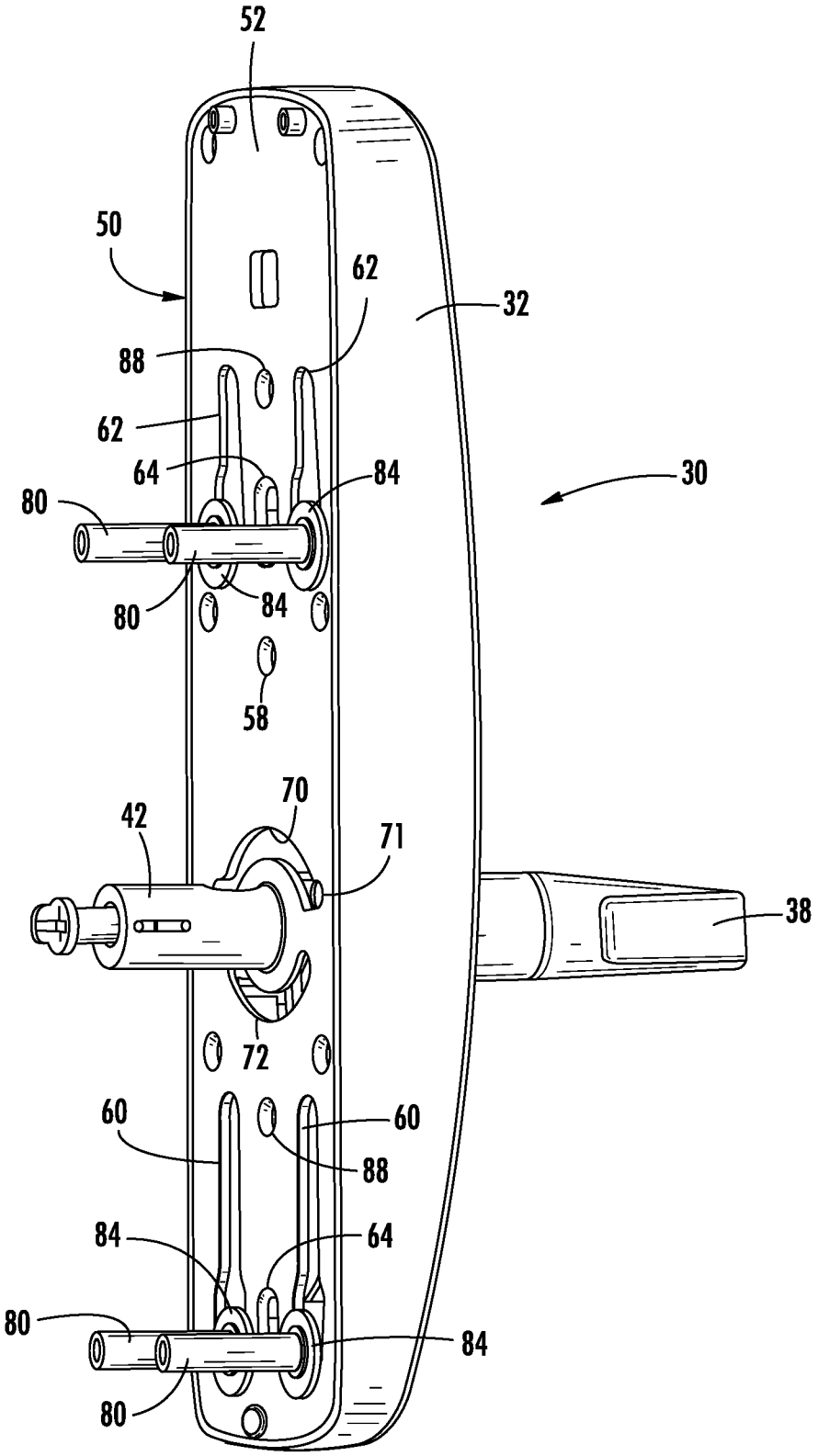
FIG. 8 is an inner side perspective view of the mounting plate and escutcheon as shown in FIG. 7.
Figure 9:
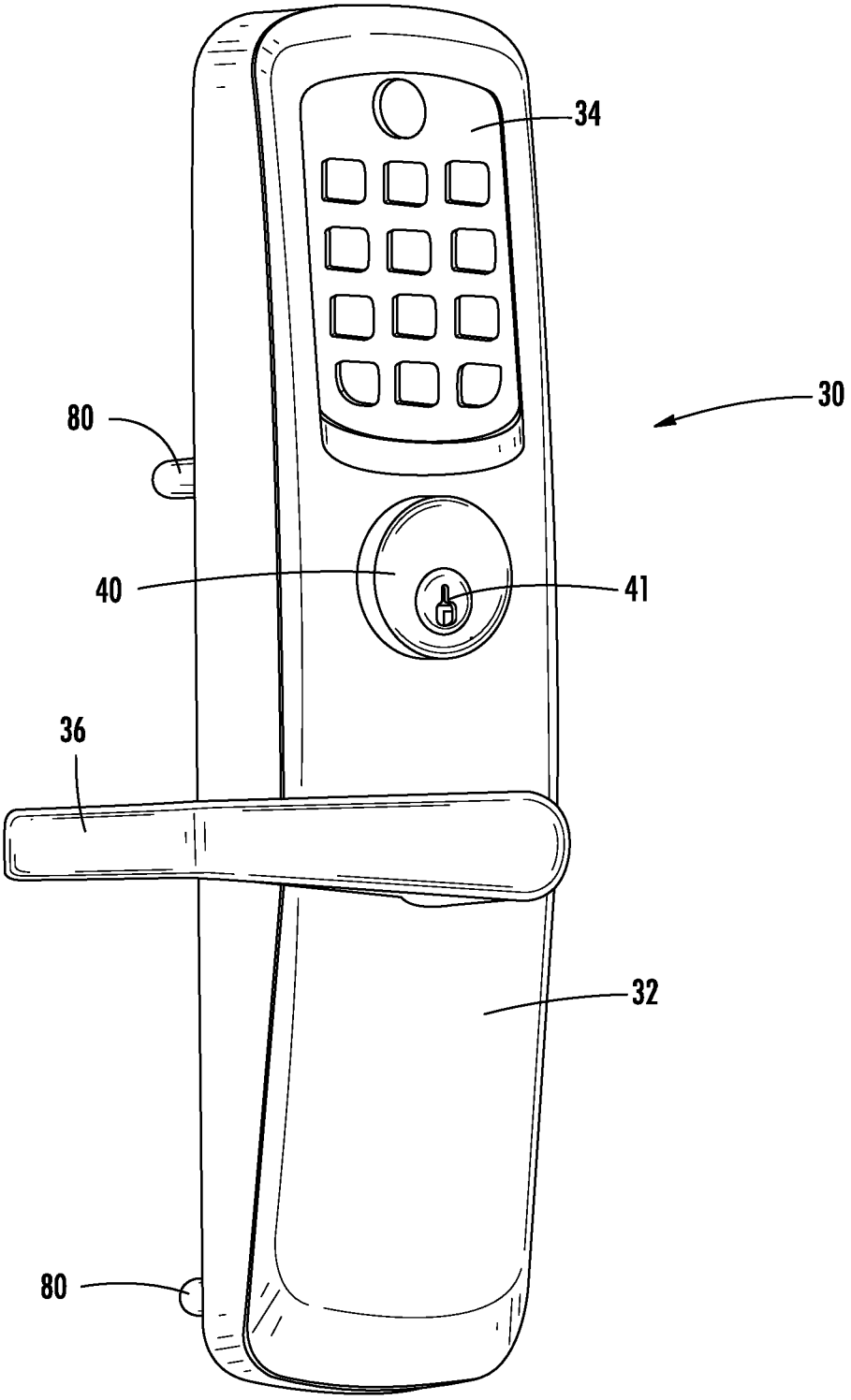
FIG. 9 is an outer perspective view of the mounting plate and escutcheon as shown in FIG. 7.

Referring to FIG. 3, the mounting plate 50 is an elongated, generally rectangular planar member having an inner surface 52 and an outer surface 54. The mounting plate 50 defines a large circular aperture 56 positioned intermediate along a central longitudinal axis. The central aperture 56 is configured for allowing a latch spindle 42 to extend through the door for connection to the latch mechanism (FIGS. 7 and 8). The ends of the spindle 42 are configured for operative connection to the latch operator 38, including a knob or lever handle, to effect rotation of the spindle 42. A second pass through opening 58 is formed above the central aperture 56 along the central longitudinal axis of the mounting plate 50. The second opening 58 is configured for passing a tailpiece of the cylinder lock 40 for operative interconnection to a deadbolt or other locking mechanism on one side of the door and an associated thumb turn on the other side of the door. The cylinder lock 40 defines a keyway in the cover 32 of the escutcheon 30 for receiving a key for operating the cylinder lock or other dead lock mechanism (FIG. 9).

The mounting plate 50 defines two pairs of elongated parallel slots 60, 62. A first pair of lower slots 60 is positioned below the central aperture 56 and extends parallel to and mutually equidistant from the central longitudinal axis of the mounting plate 50. A second pair of upper slots 62 is positioned above the central aperture 56 and also extends parallel to and mutually equidistant from the central longitudinal axis of the mounting plate 50. The lower pair of slots 60 has a longer length dimension than the upper pair of slots 62. One of each of the pair of upper slots 62 and the lower slots 60 share a common longitudinal axis. A third pair of slots 64 is provided. Each slot of the third pair of slots 64 extends only a short distance along the central longitudinal axis of the mounting plate 50 above and below the central aperture 56. The lower end 65 of each of the third pair of slots 64 is aligned with the lower ends 63, 65 of the first pair of slots 60 and the second pair of slots 62, respectively.

An upper arcuate slot 70 and a lower arcuate slot 72 are mirror symmetrically arranged above and below, respectively, the central aperture 56. The upper arcuate slot 70 terminates in short transverse slot portions 71 at each end. The upper and lower arcuate slots 70, 72 allow different possible fastener arrangements at a range of angular alignments relative to the central aperture 56.

As shown in the drawings, pairs of fasteners 80 are configured to be received in the elongated slots 60, 62 and the arcuate slots 70, 72. The fasteners 80 are configured to be slidably adjustable along the length of the slots 60, 62, 70, 72 relative to the central aperture 56 for aligning with fixing holes through the door. The lower elongated slots 60 and the upper elongated slots 62 are slightly wider than the fasteners 80 such that the fasteners are slidable within a vertical and a horizontal envelope defined by the particular slots so as to be able to adjust to the fixing holes in both the vertical and the horizontal directions.

Figure 20:
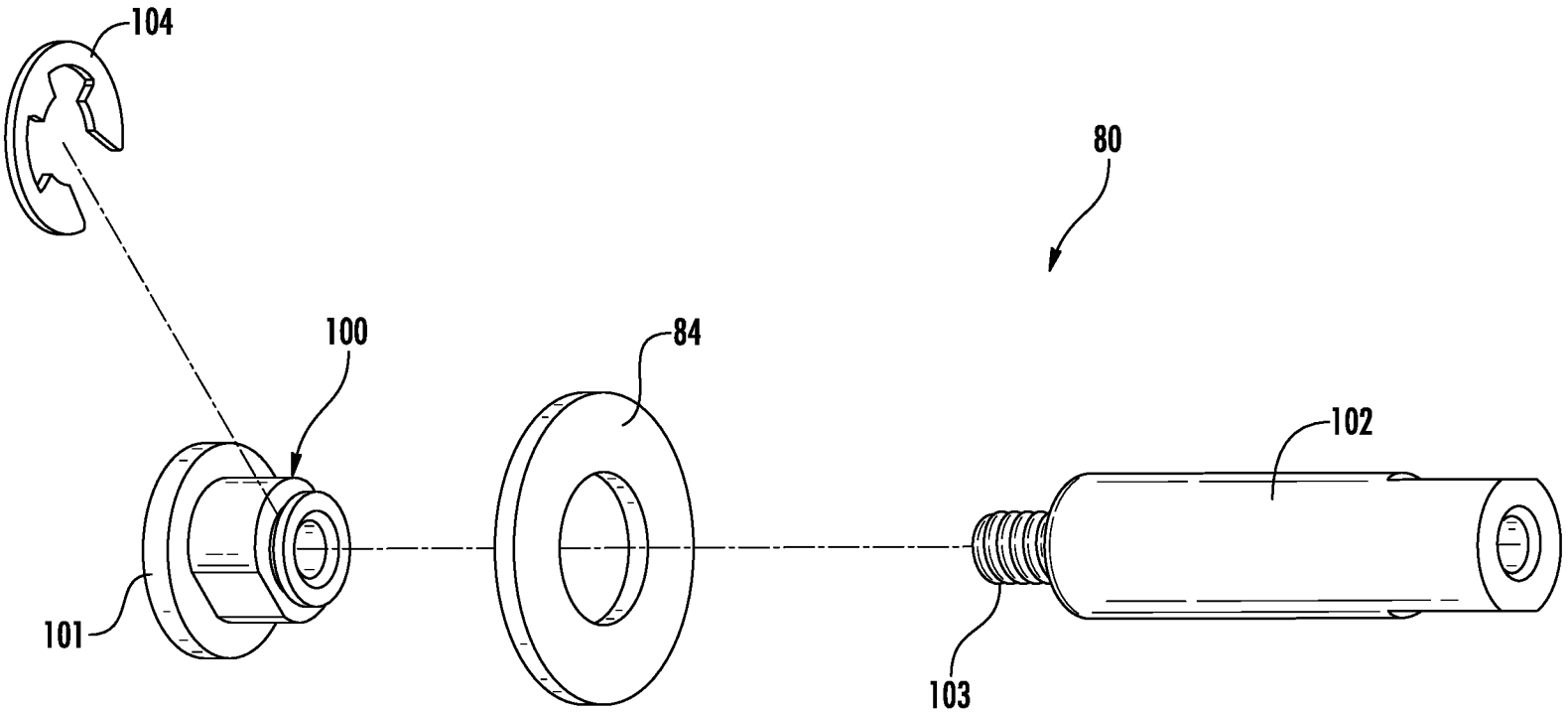
FIG. 20 is an exploded perspective view of a fastener for use with the embodiments of the mounting plate as described herein.

Referring to FIGS. 5, 6, 12, 14, 15 and 19, the fasteners 80 are preassembled to a bracket 82 and inserted through the slots 60, 62 such that the bracket 82 engages the outer surface 54 of the mounting plate 50. As shown in FIG. 20, each of the fasteners 80 comprises a head portion 100 and a post 102. The head portion 100 terminates in a proximal flange 101 that is of larger diameter than the corresponding opening at each end of the bracket 82. The proximal end 103 of the post 102 has a narrower diameter than the remaining body of the post 102 and is externally threaded. The head portion 100 of each fastener 80 is internally threaded for receiving the proximal end 103 of the post 102. The distal end of the posts 102 are internally threaded for receiving fasteners via the fixing holes from the opposite side of the door.

In use, each of the head portions 100 of the fasteners 80 is inserted through an opening in the bracket 82 until the proximal flange 101 of the head portion 100 engages the surface of the bracket 82. The distal end of the head portion 100 has a circumferential groove 106 for receiving a spring clip 104 for fixing the head portion 100 in the bracket 82 and securing the mounting plate 50 between the transverse bracket 82 and the spring clip 104. This arrangement conveniently holds the pairs of fasteners 80 and bracket 82 together during installation. A washer 84 fits over the distal end of the head portion 100 and engages the inner surface 52 of the mounting plate 50. The post 102 is then threaded into the head portion 100 for securing the assembled fastener 80 and brackets 82 relative to the mounting plate 50. This arrangement allows the assembled fasteners 80 and the bracket 82 to slide together into a relative longitudinal position along the slots 60, 62 so as to align with the existing fixing holes in the door.

The brackets 82 have a central threaded hole 86 for receiving a screw 87 extending through one, or both, of the third pair of slots 64 or through one or two dedicated screw holes 88 along the central longitudinal axis of the mounting plate 50 and aligned with the upper end of the vertical slots 60, 62.

The mounting plate 50 has a plurality of assembly apertures located at its four corners and several other positions spaced along the mounting plate 50. The mounting plate 50 is fixed to the escutcheon cover 32 via the apertures using threaded fasteners. The inside of the cover 32 of the escutcheon 30 facing the door is of complementary shape to the periphery of the mounting plate 50. When the escutcheon 30 is assembled, the mounting plate 50 is received in a cavity defined by the cover 32 and concealed within the escutcheon 30.

Assembling the escutcheon 30 begins with positioning fasteners 80 in the mounting plate 50 to correspond to the associated door hardware on the other side of the door 31. As described above, the heads 100 of the fasteners 80 are passed through the brackets 82, 83 and selected slots 60, 62, 70, 72 in the mounting plate 50. Spring clips 85 and washers 84 are slid into position on the heads 100 against the surface 52 of the mounting plate 50 and the posts 102 are threaded into the heads 100. The slots 60, 62, 70, 72 permit adjustment of the fasteners 80 relative to the central aperture 56 so as to suit different sizes and styles of door hardware. This selective adjustability enables the vertical, horizontal or angular adjustment of the fasteners 80 to achieve the desired hole mounting positions in the appropriate spacing range. The spindle 42 is inserted into the central aperture for operatively connection to the latch operator 38. The mounting plate 50 is then secured to the cover 32 of the escutcheon 30. The posts 102 of the fasteners 80 are then inserted in the fixing holes through the door. Fasteners from the opposite side of the door and associated with the door hardware are inserted into the threaded posts 102 via the fixing holes and threadably engaged to secure the mounting plate 50 and the escutcheon 30 firmly to the door hardware and to the door.

Figure 5:
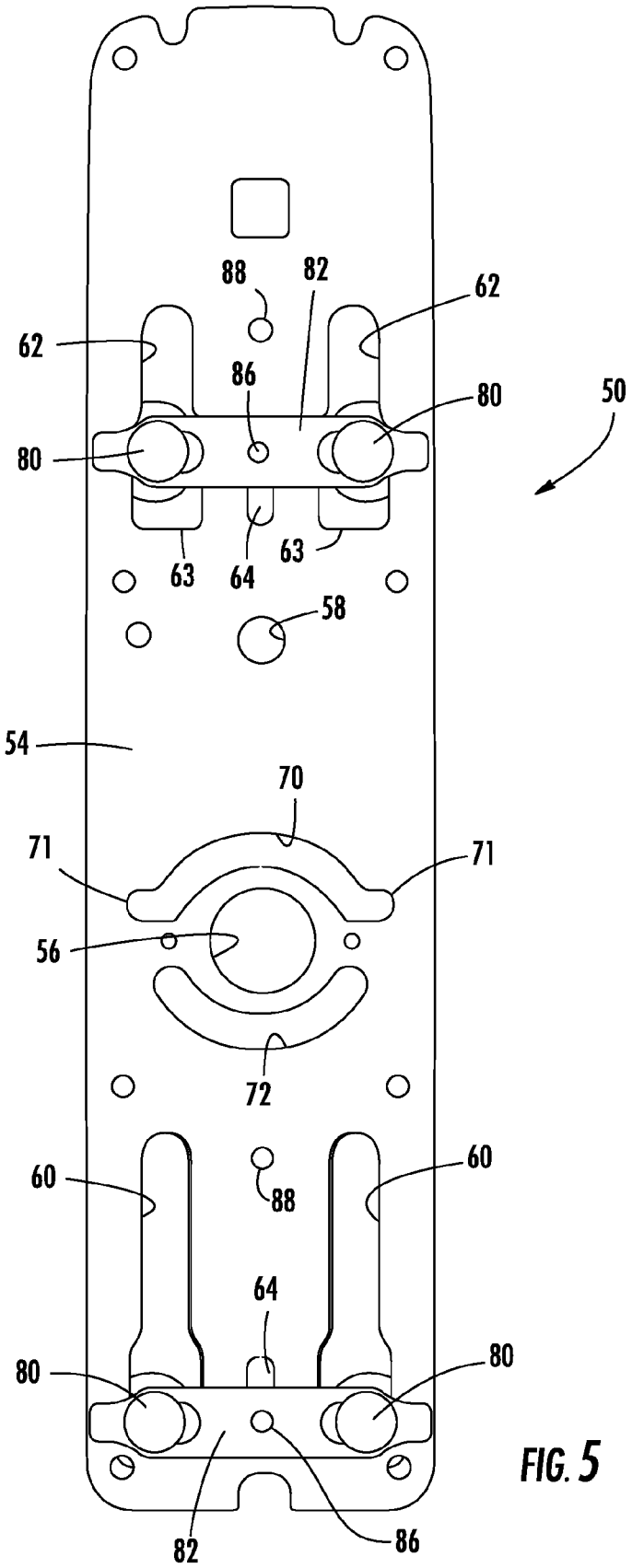
FIG. 5 is an outer elevation view of the mounting plate as shown in FIG. 3.
Figure 6:
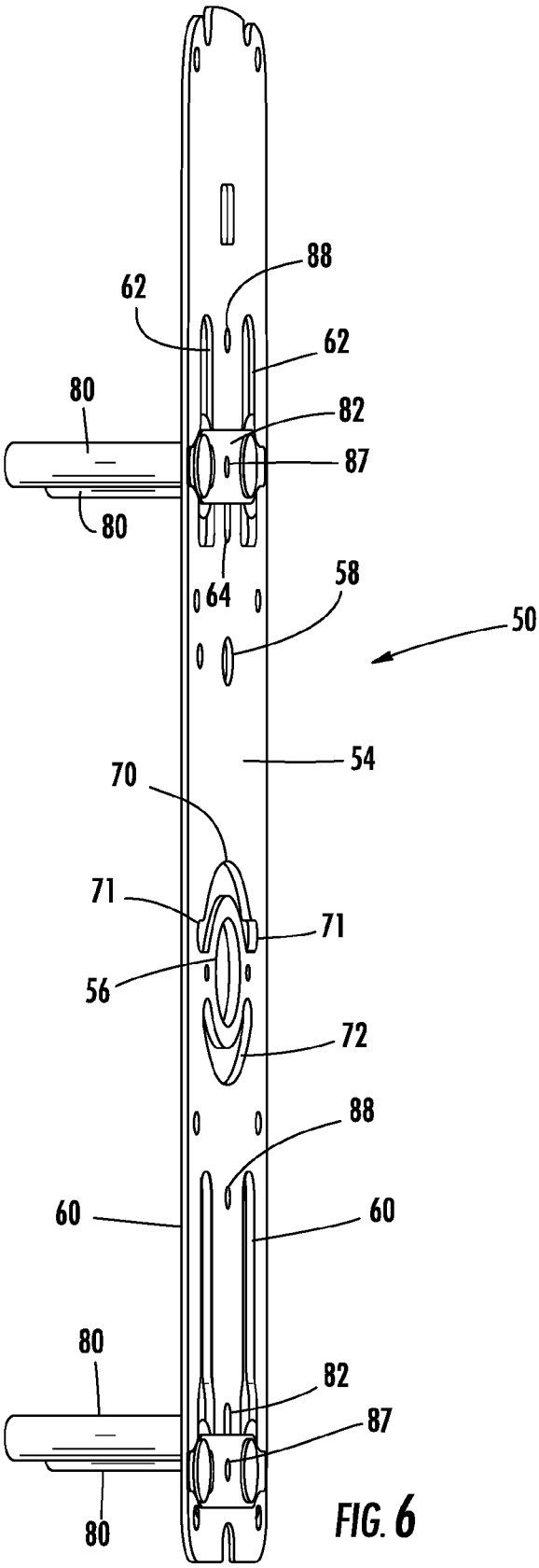
FIG. 6 is an outer side perspective view of the mounting plate as shown in FIG. 3.

FIGS. 3-6 show one example of an arrangement of the mounting plate 50 and the escutcheon 30 for connection to a Yale brand pushbar exit device. The fasteners 80 including the internally threaded connecting posts 102 are disposed adjacent to the lower ends of the upper pair 62 and the lower pair 60 of elongated slots in the mounting plate 50. As shown in FIG. 5, each pair of fasteners 80 is connected through the bracket 82 transversely spanning the outer surface 54 of the mounting plate 50. The washers 84 pushed over the threaded posts to the inner surface of the mounting plate 50 for securing the mounting plate 50 between the transverse brackets 82 and the washers 84. The center threaded opening 86 of the bracket 82 receives the screw 87 through the third pair of slots 64 for fixing the brackets 82 and the fasteners 80 in a selected position along the slots 60, 62.

FIGS. 7-9 show the mounting plate 50 as a part of the assembled escutcheon 30, including the cover 32 and the lever handle 38 mounted on the spindle 42.

Figure 10:
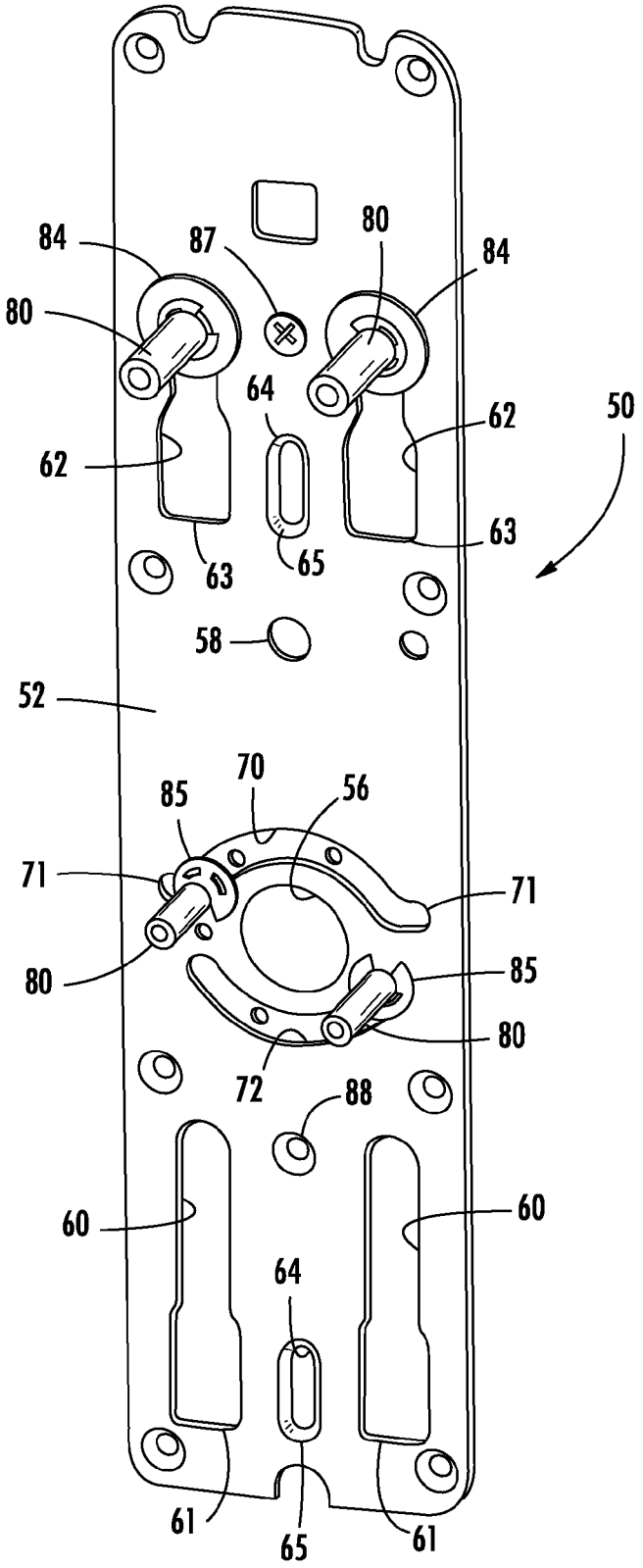
FIG. 10 is an inner perspective view of an embodiment of a mounting plate for use in securing an escutcheon to one side of a door and a mortise lock on another side of the door.
Figure 11:
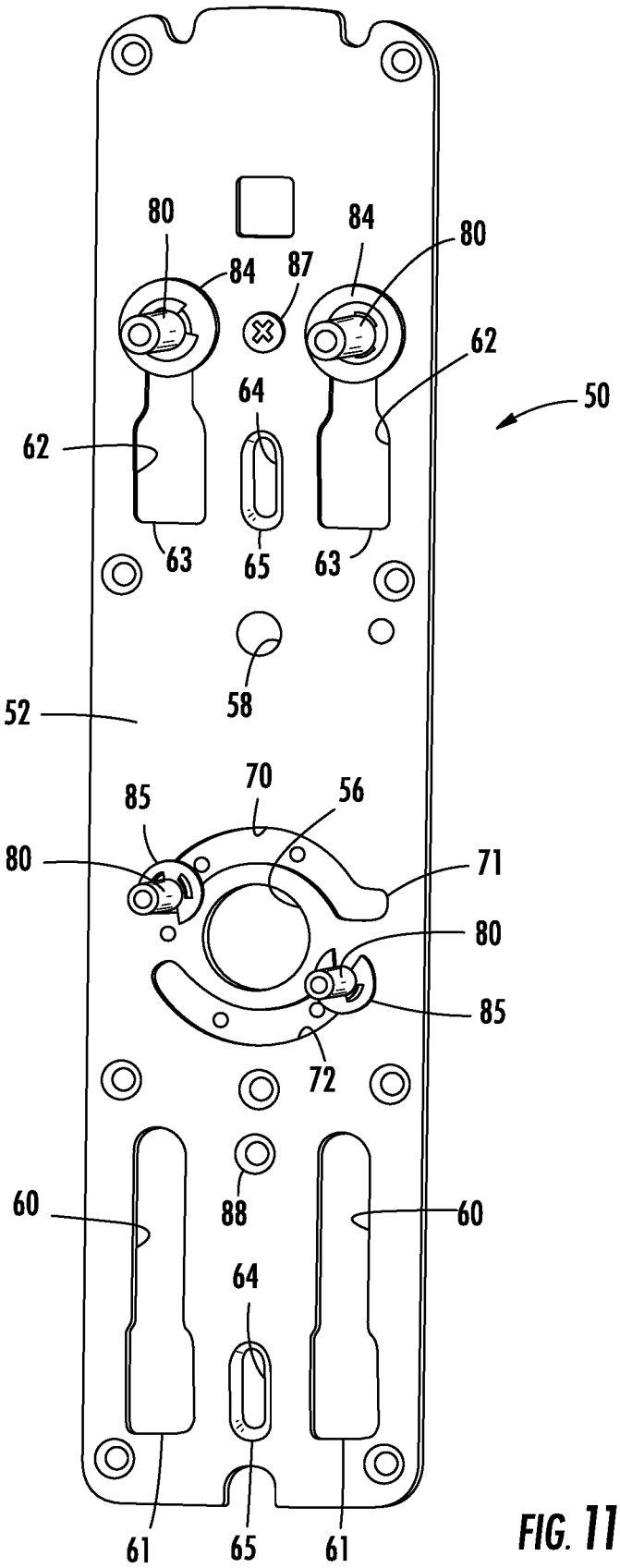
FIG. 11 is an inner elevation view of the mounting plate as shown in FIG. 10.
Figure 12:
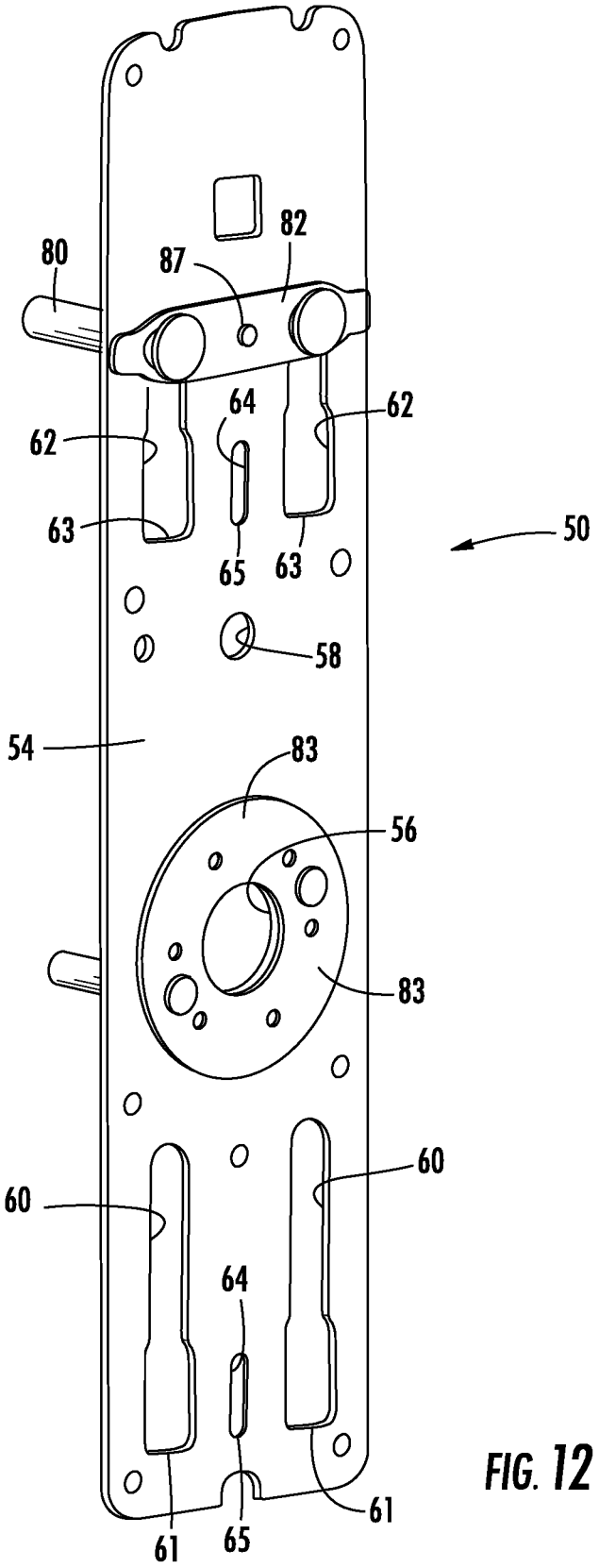
FIG. 12 is an outer perspective view of the mounting plate as shown in FIG. 10.

In another example shown in FIGS. 10-12, the escutcheon mounting plate 50 and fasteners 80 are arranged for connection to a Yale brand mortise lock. In this example, a pair of fasteners 80 is positioned at the upper end of the upper pair of slots 62 in the mounting plate 50. The pair of fasteners 80 is connected through a transverse bracket 82 spanning the outer surface 54 of the mounting plate 50 (FIG. 12). A screw 87 is threaded through the upper central opening 88 into the center threaded opening of the bracket 82 for fixing the bracket and the fasteners 80 at the upper end of the upper pair of slots 62. A second pair of fasteners 80 is positioned at opposite ends of the pair of arcuate slots 70, 72 surrounding the central aperture 56 in the mounting plate 50. As shown in FIG. 12, this pair of fasteners 80 is connected through a donut bracket 83 secured against the outer surface of the mounting plate 50 and surrounding the central aperture 50. The spring clips 104 around the fasteners 80 engage the inner surface 52 of the mounting plate 50 securing the mounting plate between the donut bracket 83 and the spring clips 104.

Figure 13:
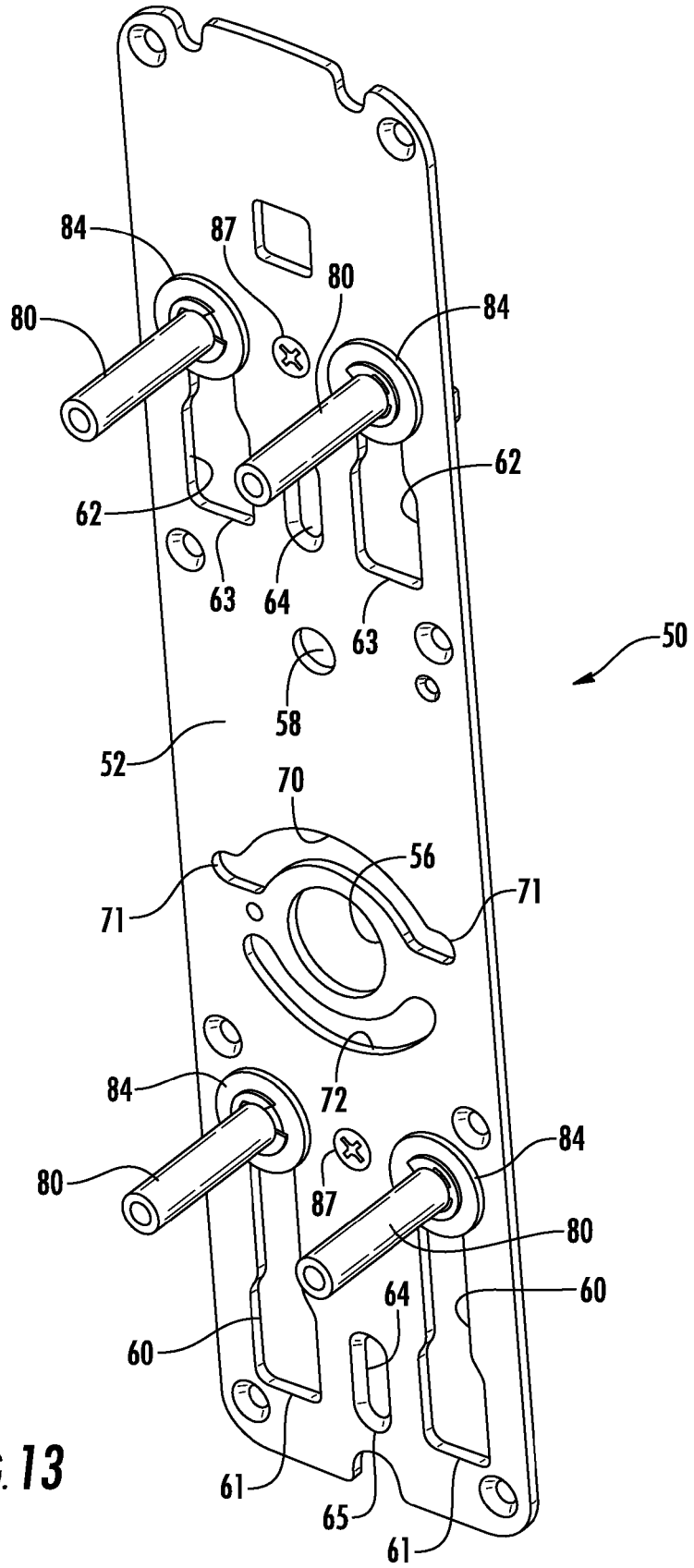
FIG. 13 is an inner perspective view of an embodiment of a mounting plate for use in securing an escutcheon to one side of a door and to another embodiment of a pushbar exit device on another side of the door.
Figure 14:
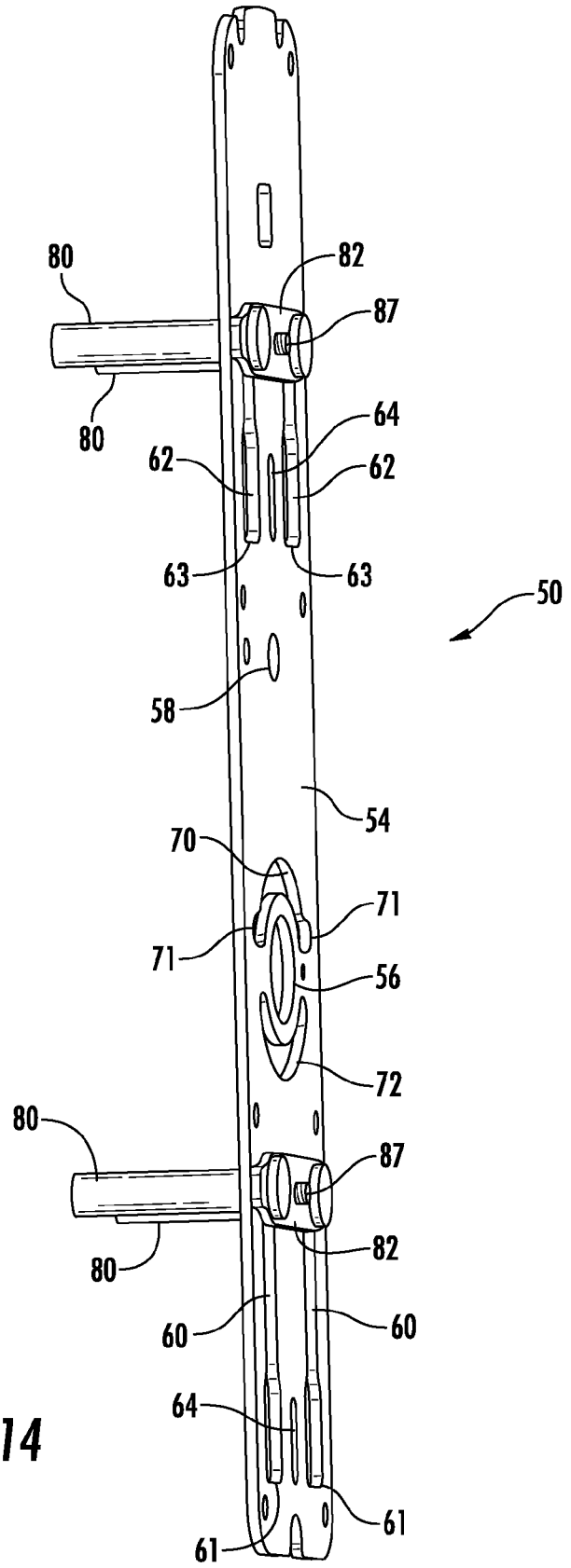
FIG. 14 is an outer side perspective view of the mounting plate as shown in FIG. 13.
Figure 15:
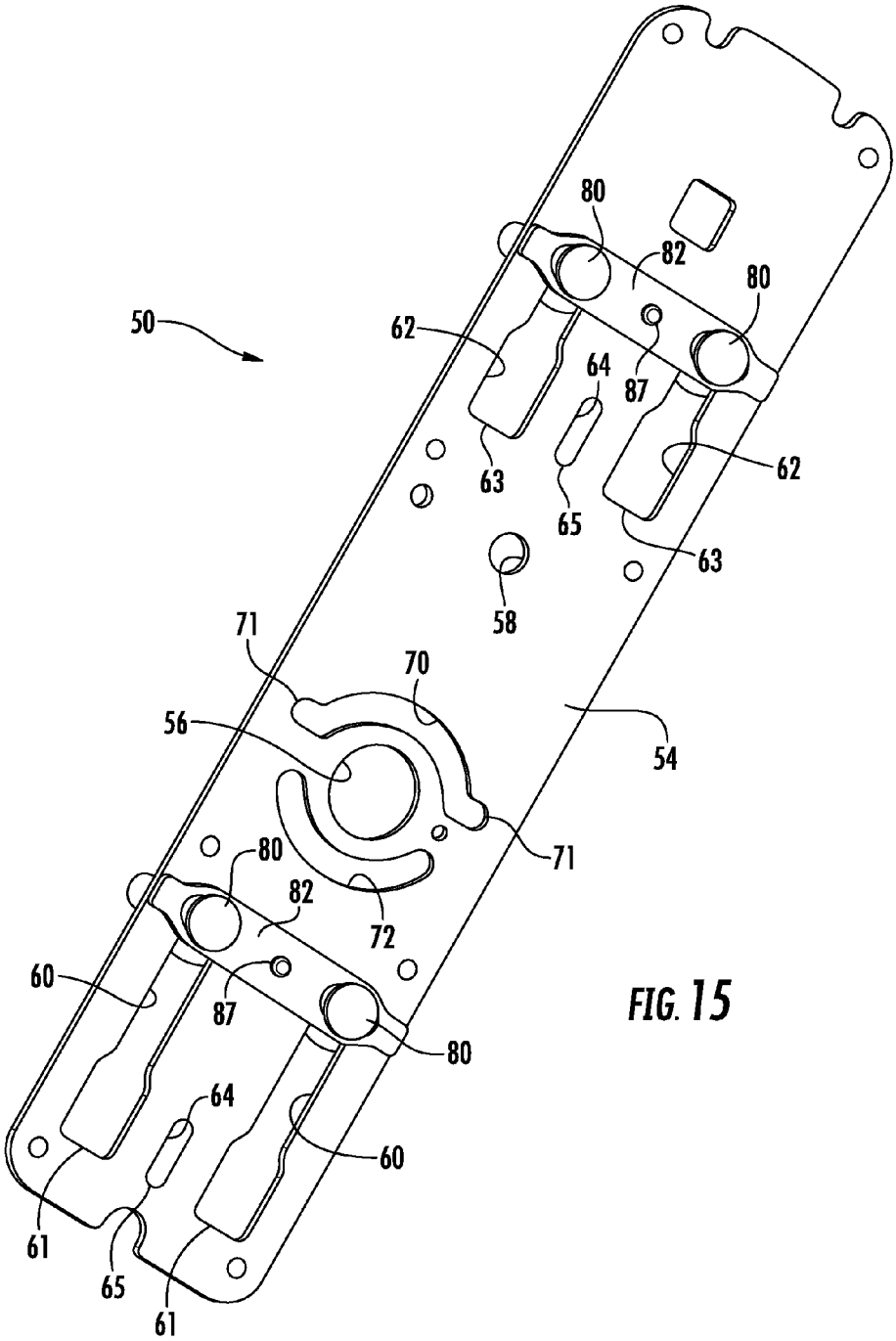
FIG. 15 is an outer perspective view of the mounting plate as shown in FIG. 13.
Figure 16:
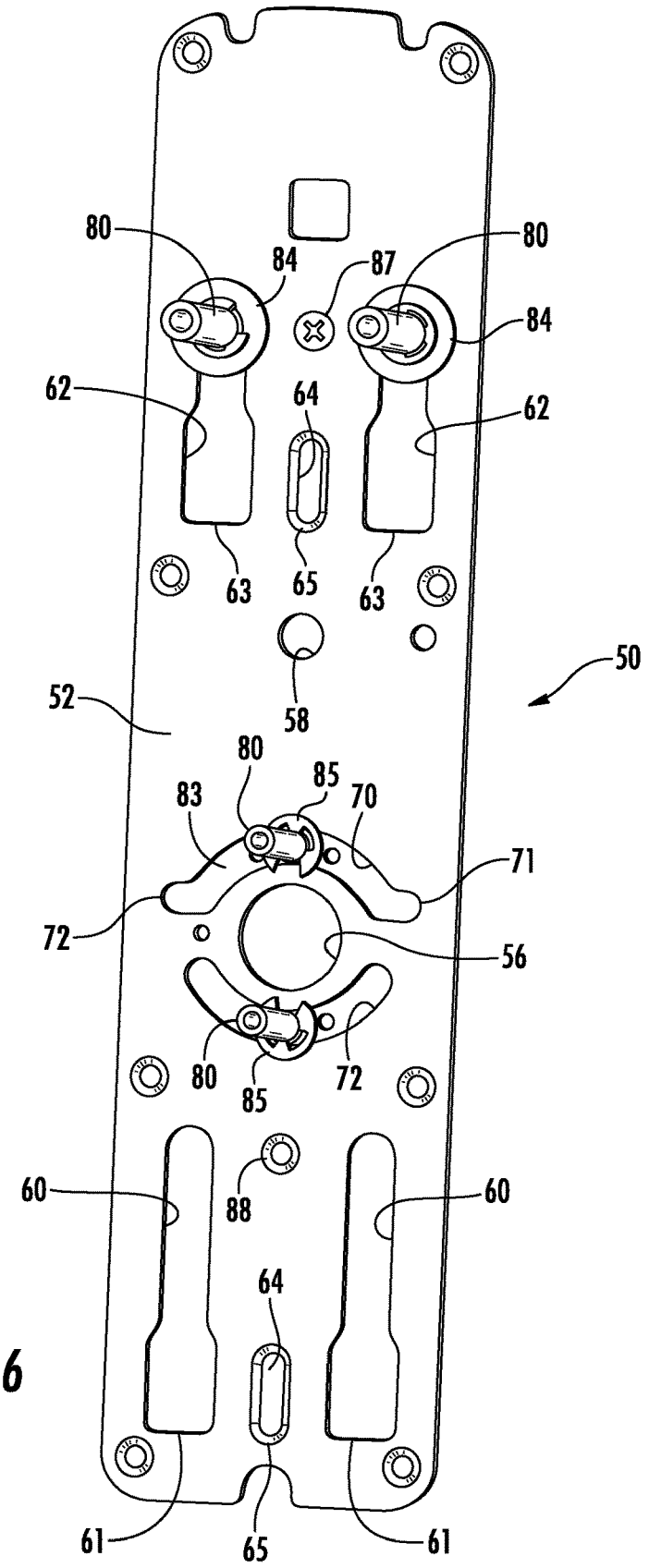
FIG. 16 is an inner perspective view of an embodiment of a mounting plate for use in securing an escutcheon to one side of a door and to a mortise lock on another side of the door.
Figure 17:
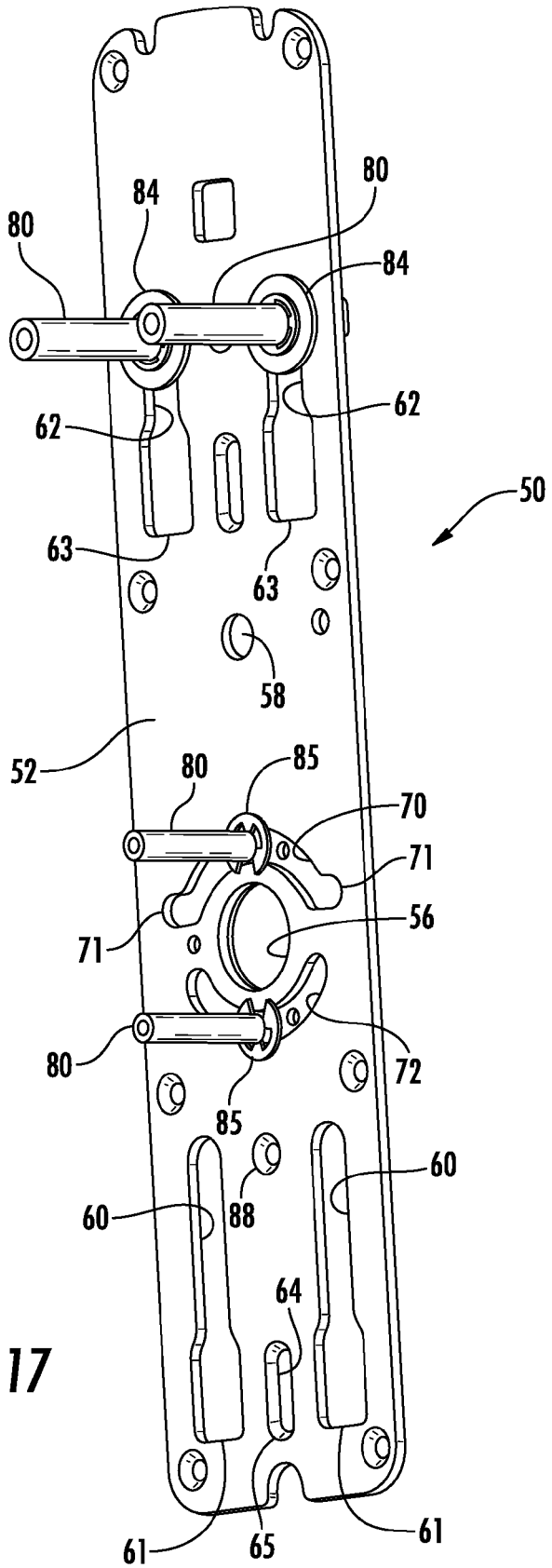
FIG. 17 is an inner side perspective view of the mounting plate as shown in FIG. 16.
Figure 18:
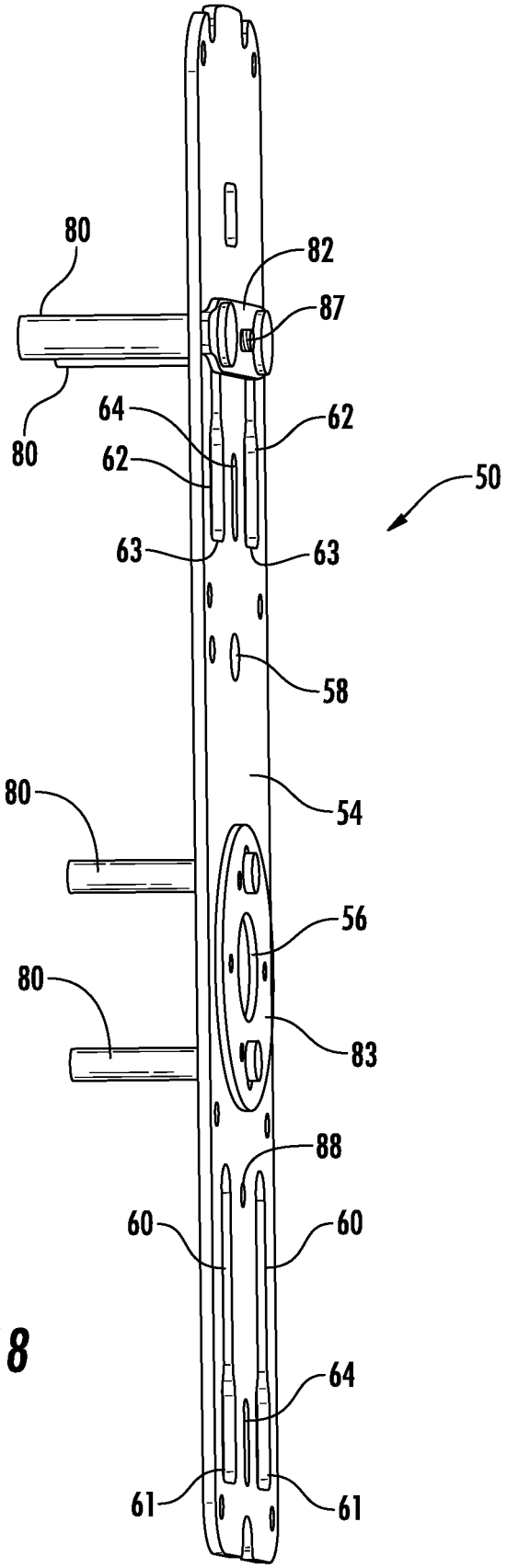
FIG. 18 is an outer side perspective view of the mounting plate as shown in FIG. 16.
Figure 19:
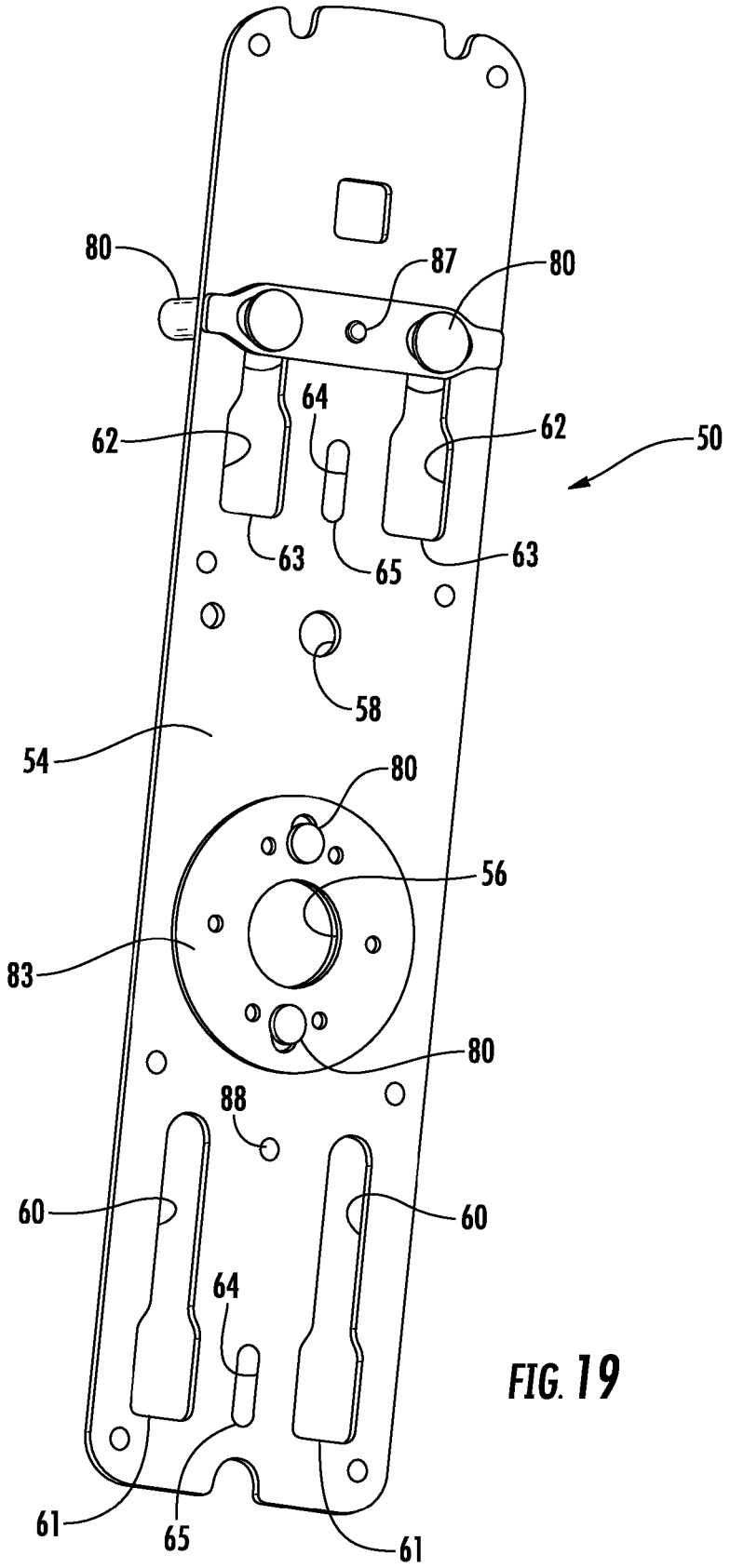
FIG. 19 is an outer perspective view of the mounting plate as shown in FIG. 16.

FIGS. 13-15 show another example of the escutcheon mounting mounting plate 50 wherein fasteners 80 are disposed at the upper ends of the upper pair 62 and the lower pair 60 of the elongated vertical slots for connection to an Arrow brand pushbar exit device. In this example, a pair of fasteners 80 is positioned at the upper end of the upper pair of slots 62 in the mounting plate 50 as in the previous example shown in FIGS. 10-12. In addition, a pair of fasteners 80 is also positioned at the upper end of the lower pair of slots 60 in the mounting plate 50. The lower pair of fasteners 80 is connected through a transverse bracket 82 spanning the outer surface 54 of the mounting plate 50 (FIG. 15). A screw 87 is threaded through the lower central opening 88 into the center threaded opening of the bracket 82 for fixing the bracket and the fasteners 80 at the upper end of the lower pair of slots 60. The spring clips 104 pushed over the outer ends of each of the headportions 100 of the fasteners 80 secures the mounting plate 50 between the transverse brackets 82 and the spring clips 104.

FIGS. 16-19 show yet another example wherein the escutcheon mounting mounting plate 50 and fasteners 50 are arranged for connection to an Arrow brand mortise lock. This arrangement is similar to the example for connection to the Yale mortise lock shown in FIGS. 10-12. However, in this example, a second pair of fasteners 80 is disposed in vertically opposite positions at the midpoint of the arcuate slots 70, 72 surrounding the central aperture 50.

The escutcheon mounting mounting plate has many advantages, including providing an escutcheon mounting plate with the capability to be assembled to different locks and door hardware including both a tubular and mortise assembly. In this way, the mounting base can thus be used universally to mount to any underlying structure for any brand or type of exit device or lock. In a retrofit application, the escutcheon mounting plate can be used in cooperation with the existing fixing holes through a door for assembly to hardware and avoid the necessity of drilling fresh holes for the replacement. The commonality of the escutcheon mounting mounting plate reduces expense and inventory considerations.

Although the escutcheon mounting plate has been shown and described in considerable detail with respect to only a few exemplary embodiments thereof, it should be understood by those skilled in the art that we do not intend to limit the mounting plate to the embodiments since various modifications, omissions and additions may be made to the disclosed embodiments without materially departing from the novel teachings and advantages of the mounting plate, particularly in light of the foregoing teachings. Accordingly, we intend to cover all such modifications, omission, additions and equivalents as may be included within the spirit and scope of the following claims. In the claims, means-plus-function clauses are intended to cover the structures described herein as performing the recited function and not only structural equivalents but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures.

We claim:

1. A mount assembly for securing an escutcheon on a major side surface of a door having opposite major side surfaces and a plurality of holes therethrough, the mount assembly comprising:

an elongated planar plate member adapted to be secured to the major side surface of the door, the plate member having an upper end and a lower end and a central longitudinal axis extending between the upper end and the lower end, the plate member having a central aperture symmetrically disposed on the central longitudinal axis and an upper pair of elongated slots mirror symmetrically arranged with respect to the central longitudinal axis adjacent the upper end of the plate member and a lower pair of elongated slots mirror symmetrically arranged with respect to the central longitudinal axis adjacent the lower end of the plate member, each of the elongated slots extending parallel to and equidistant from the central longitudinal axis, the plate member further having an upper arcuate slot and a lower arcuate slot, the arcuate slots being elongated and extending along an elongated direction radially about the central aperture and radially spaced an equal distance from the center of the central aperture, the upper arcuate slot terminating in elongated linear portions extending along an elongated direction perpendicular to the central longitudinal axis of the plate member;

a plurality of fasteners, each one of the plurality of fasteners slidably received in a corresponding elongated slot of the upper pair of elongated slots and the lower pair of elongated slots for positioning of the fastener relative to the central aperture, wherein the fastener can be located within the corresponding elongated slot at a plurality of selected distances from the central aperture for alignment with a hole through the door; and a fastener slidably received in at least one of the upper arcuate slot and the lower arcuate slot for positioning of the fastener relative to the central aperture, wherein the fastener can be located at selected angular positions for alignment with a hole through the door.

2. The mount assembly as recited in claim 1, wherein each slot has a width configured for a tolerance allowing movement of the fastener transverse to the central longitudinal axis.

3. The mount assembly as recited in claim 1, wherein each fastener further comprises a post, each post being internally threaded.

4. The mount assembly as recited in claim 1, further comprising a means for fixing a position of the fastener along the slot.

5. The mount assembly as recited in claim 1, wherein the plate member has an outer surface, the mount assembly further comprising a bracket extending between each fastener in one pair of the slots and adapted to interconnect the fasteners and engage the outer surface of the plate member.

6. The mount assembly as recited in claim 5, wherein the plate member has a third pair of slots along the central longitudinal axis, each of the third pair of slots longitudinally spaced from the other slot on opposite sides of the central aperture and having a lower end equidistant from the central aperture as the lower ends of the upper pair slots and the lower ends of the lower pair of slots, and further comprising a screw extending through each slot of the third pair of slots for securing the bracket relative to the plate member along the slot.

7. The mount assembly as recited in claim 1, further comprising a means for fixing a position of the fastener along the arcuate slot.

8. The mount assembly as recited in claim 1, wherein the plate member has an outer surface, the mount assembly further comprising a bracket extending between each fastener in the arcuate slots and adapted to interconnect the fasteners and engage the outer surface of the plate member.

9. A combination of a mount assembly and escutcheon comprising:

a mount assembly comprising:

an elongated planar plate member adapted to be secured to a major side surface of a door, the plate member having an upper end and a lower end and a central longitudinal axis extending between the upper end and the lower end, the plate member having a central aperture symmetrically disposed on the central longitudinal axis and an upper pair of elongated slots mirror symmetrically arranged with respect to the central longitudinal axis adjacent the upper end of the plate member and a lower pair of elongated slots mirror symmetrically arranged with respect to the central longitudinal axis adjacent the lower end of the plate member, each of the elongated slots extending parallel to and equidistant from the central longitudinal axis, the plate member further having an upper arcuate slot and a lower arcuate slot, the arcuate slots being elongated and extending along an elongated direction radially about the central aperture and radially spaced an equal distance from the center of the central aperture, the upper arcuate slot terminating in elongated linear portions extending along an elongated direction perpendicular to the central longitudinal axis of the plate member;

a fastener slidably received in at least one of the upper pair of elongated slots and the lower pair of elongated slots for positioning of the fastener relative to the central aperture, wherein the fastener can be located within a corresponding elongated slot at one of a plurality of selected distances from the central aperture for alignment with a hole through the door; and a fastener slidably received in at least one of the upper arcuate slot and the lower arcuate slot for positioning of the fastener relative to the central aperture, wherein the fastener can be located at selected angular positions for alignment with a hole through the door; and, an escutcheon comprising:

an inner surface defining a peripheral recess, wherein the plate member is configured to be received in the recess.

10. The combination as recited in claim 9, further comprising a latch spindle rotating disposed on the escutcheon and extending through the central aperture.

11. The combination as recited in claim 10, further comprising a latch operator movably supported on the escutcheon and engaged with the latch spindle to effect rotation of the latch spindle.

12. A door assembly comprising:

a door having opposite major side surfaces and a plurality of holes therethrough;

a mount assembly for securing an escutcheon on one of the major side surfaces of the door, the mount assembly comprising:

an elongated planar plate member configured to be secured to the major side surface of the door, the plate member having an upper end and a lower end and a central longitudinal axis extending between the upper end and the lower end, the plate member having a central aperture symmetrically disposed on the central longitudinal axis and an upper pair of elongated slots mirror symmetrically arranged with respect to the central longitudinal axis adjacent the upper end of the plate member and a lower pair of elongated slots mirror symmetrically arranged with respect to the central longitudinal axis adjacent the lower end of the plate member, each of the elongated slots extending parallel to and equidistant from the central longitudinal axis, the plate member further having an upper arcuate slot and a lower arcuate slot, the arcuate slots being elongated and extending along an elongated direction radially about the central aperture and radially spaced an equal distance from the center of the central aperture, the upper arcuate slot terminating in elongated linear portions extending along an elongated direction perpendicular to the central longitudinal axis of the plate member;

a plurality of fasteners, each one of the plurality of fasteners slidably received in a corresponding elongated slot of the upper pair of elongated slots and the lower pair of elongated slots for positioning of the fastener relative to the central aperture, wherein the fastener can be located within the corresponding elongated slot at a plurality of selected distances from the central aperture for alignment with a hole through the door when a door aperture is aligned with the central aperture of the plate member; and a fastener slidably received in at least one of the upper arcuate slot and the lower arcuate slot for positioning of the fastener relative to the central aperture, wherein the fastener can be located at selected angular positions for alignment with a hole through the door.

13. The door assembly as recited in claim 12, wherein each slot has a width configured for a tolerance allowing movement of the fastener transverse to the central longitudinal axis.

14. The door assembly as recited in claim 12, wherein each fastener further comprises a post, each post being internally threaded.

15. The door assembly as recited in claim 12, further comprising a means for fixing a position of the fastener along the slot.

16. The door assembly as recited in claim 12, wherein the plate member has an outer surface, the mount assembly further comprising a bracket extending between each fastener in one pair of the slots and adapted to interconnect the fasteners and engage the outer surface of the plate member.

17. The door assembly as recited in claim 16, wherein the plate member has a third pair of slots along the central longitudinal axis, each of the third pair of slots longitudinally spaced from the other slot on opposite sides of the central aperture and having a lower end equidistant from the central aperture as the lower ends of the upper pair slots and the lower ends of the lower pair of slots, and further comprising a screw extending through each slot of the third pair of slots for securing the bracket relative to the plate member along the slot.

18. The door assembly as recited in claim 12, further comprising a means for fixing a position of the fastener along the arcuate slot.

19. The door assembly as recited in claim 12, wherein the plate member has an outer surface, the mount assembly further comprising a bracket extending between each fastener in the arcuate slots and adapted to interconnect the fasteners and engage the outer surface of the plate member.

20. The door assembly as recited in claim 12, further comprising an escutcheon having an inner surface defining a peripheral recess, wherein the plate member is configured to be received in the recess.

21. The door assembly as recited in claim 20, further comprising a latch spindle rotating disposed on the escutcheon and extending through the central aperture and the door aperture.

22. The door assembly as recited in claim 21, further comprising a latch operator movably supported on the escutcheon and engaged with the latch spindle to effect rotation of the latch spindle.

* * * * *